US005576824A

United States Patent [19]

Folkins

[11] Patent Number: 5,576,824

[45] Date of Patent: Nov. 19, 1996

[54] FIVE CYCLE IMAGE ON IMAGE PRINTING ARCHITECTURE

[75] Inventor: Jeffrey J. Folkins, Rochester, N.Y.

[73] Assignee: Xerox Corporation, Stamford, Conn.

[21] Appl. No.: 472,164

[22] Filed: Jun. 7, 1995

[51] Int. Cl.[6] ..... G03G 15/01

[52] U.S. Cl. ..... 355/327; 430/44

[58] Field of Search ..... 355/326 R, 327; 118/645; 430/44

[56] References Cited

U.S. PATENT DOCUMENTS

| | | | |
|---|---|---|---|
| 3,392,667 | 7/1968 | Cassel et al. | 101/170 |
| 3,399,611 | 9/1968 | Lusher | 95/1.7 |
| 3,955,530 | 5/1976 | Knechtel | 118/60 |
| 3,957,367 | 5/1976 | Goel | 355/4 |
| 4,348,098 | 9/1982 | Koizumi | 355/3 TR |
| 4,515,460 | 5/1985 | Knechtel | 355/3 TR |
| 4,588,279 | 5/1986 | Fukuchi et al. | 355/3 TR |
| 4,935,788 | 6/1990 | Fantuzzo et al. | 355/326 |
| 5,254,424 | 10/1993 | Felder | 430/112 |
| 5,352,558 | 10/1994 | Simms et al. | 430/125 |
| 5,355,201 | 10/1994 | Hwang | 355/256 |

*Primary Examiner*—R. L. Moses
*Attorney, Agent, or Firm*—John M. Kelly

[57] ABSTRACT

A 5 cycle color electrophotographic printing architecture. In the first cycle the photoreceptor is erased, charged, exposed to create a first electrostatic latent representation, and developed with a first color of toner. In the second cycle the photoreceptor is recharged using a split recharging scheme, exposed to light to create a second electrostatic latent representation, and developed with a second color of toner. In the third cycle the photoreceptor is recharged using a split recharging scheme, exposed to create a third latent representation, and developed using a third color of toner. In the fourth cycle the photoreceptor is recharged using a split recharging scheme, exposed to create a fourth latent representation, and developed with a fourth color of toner. In the fifth cycle the photoreceptor and the four toner layers are exposed to a pretransfer erase lamp, charged to assist in transfer, transferred onto a substrate using a corona generating device. The substrate is separated from the photoreceptor and passed through a fusing station. Meanwhile the photoreceptor is cleaned in preparation for printing another image.

3 Claims, 2 Drawing Sheets

FIVE CYCLE IMAGE ON IMAGE PRINTING ARCHITECTURE

FIELD OF THE INVENTION

This invention relates to the art of electrophotographic printing.

BACKGROUND OF THE INVENTION

Electrophotographic marking is a well known and commonly used method of copying or printing original documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto the latent image so as to form a toner image. That toner image is then transferred from the photoreceptor onto a substrate such as a sheet of paper. The transferred toner image is then fused to the substrate using heat and/or pressure. The surface of the photoreceptor is then cleaned of residual developing material and recharged in preparation for the production of another image.

The foregoing broadly describes a typical black and white electrophotographic printing machine. Electrophotographic printing can also produce color images by repeating the above process for each color of toner that is used to make the color image. For example, the charged photoreceptive surface may be exposed to a light image which represents a first color, say black. The resultant electrostatic latent image can then be developed with black toner particles to produce a black toner image which is subsequently transferred and fused onto a substrate. The process can then be repeated for a second color, say yellow, then for a third color, say magenta, and finally for a fourth color, say cyan. If the toner particles are placed in a superimposed registration the desired composite color image is produced. This process is sometimes referred to either as the REaD process (Recharge, Expose, and Develop) or as the IOI process (Image On Image).

While electrophotographic printing has been very successful, the rapid growth of the computer industry has created a tremendous demand for desktop printing machines, particularly color desktop printing machines. Desirable features of desktop color printing machines include high print quality, high speed printing, low cost, and small size. Those desirable characteristics are difficult to simultaneously achieve using prior art electrophotographic printing machine architectures. Therefore, new electrophotographic color printing architectures which might enable high quality, relatively high speed printing at low cost in a desktop printing machine would be highly desirable.

Various approaches have been devised to produce multicolor color copies. The following disclosures may be useful references:

U.S. Pat. No. 3,392,667
Patentee: Cassel et al.
Issued: Jul. 16, 1968
U.S. Pat. No. 3,399,611
Patentee: Lusher
Issued: Sep. 3, 1968
U.S. Pat. No. 3,955,530
Patentee: Knechtel Issued: May 11, 1976
U.S. Pat. No. 3,957,367
Patentee: Goel
Issued: May 18, 1976
U.S. Pat. No. 4,348,098
Patentee: Koizumi
Issued: Sep. 7, 1982
U.S. Pat. No. 4,515,460
Patentee: Knechtel
Issued: May 7, 1985
U.S. Pat. No. 4,588,279
Patentee: Fukuchi et al.
Issued: May 13, 1986
U.S. Pat. No. 4,935,788
Patentee: Fantuzzo et al
Issued Jun. 19, 1990
U.S. Pat. No. 5,254,424
Patentee: Felder
Issued: Oct. 19, 1993
U.S. Pat. No. 5,352,558
Patentee: Simms et al
Issued: Oct. 4, 1994
U.S. Pat. No. 5,355,201
Patentee: Hwang
Issued: Oct. 11, 1994

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,399,611 describes four image transfer stations disposed about the periphery of a rotatable cylindrical metal drum. Each image transfer station is basically the same and includes a photoconductive drum charged by a charging wire and then rotated into alignment with an image exposure station to record a latent image thereon. Powder particles are then cascaded across the latent image to develop it. The powder image is then transferred to the surface of the metal drum. The powder particles are of different colors. The completed powder image is transferred from the metal drum to an article to be decorated.

U.S. Pat. No. 3,955,530 discloses a color image forming electrophotographic printing machine. Different color developers are used to develop the latent images recorded on the photoconductive drum. Each developed image is sequentially transferred to an intermediate transfer drum. A cleaning blade is used to clean the photoconductive drum between developing different color developers. The complete image is transferred from the intermediate drum to a copy sheet.

U.S. Pat. No. 3,957,367 describes a color electrophotographic printing machine in which successive different color toner powder images are transferred from a photoconductive drum to an intermediate roller, in superimposed registration with one another, to an intermediary roller. The multilayered toner powder image is fused on the intermediary roller and transferred to the copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,515,460 describes a color electrophotographic copying machine in which four developer units develop four latent images recorded on a photoconductive drum with different color toner particles. The different color toner powder images are transferred to an endless belt in superimposed registration with one another. The resultant toner powder image is then transferred from the belt to a copy sheet.

U.S. Pat. No. 4,588,279 discloses an intermediate transfer member that has a dry toner image transferred thereto from the surface of a toner image forming member. The toner image is then transferred from the transfer member to a recording paper.

U.S. Pat. No. 4,935,788 discloses a multicolor printing system that uses liquid developing and an intermediate member.

U.S. Pat. No. 5,254,424 discloses a liquid developer material which contains toner particles formed from a urethane modified polyester.

U.S. Pat. No. 5,352,558 discloses a liquid developer system which uses an absorbing belt.

U.S. Pat. No. 5,355,201 discloses an apparatus for developing an electrostatic latent image with liquid toner.

Additionally, copending and commonly assigned U.S. Patent application, "Split Recharge Method and Apparatus for Color Image Formation," Ser. No. 08/347,617 discloses a split recharge configuration wherein a first corona generating device recharges a charge retentive surface having a developed to a higher absolute potential than a predetermined potential, and then a second corona generating device recharges the surface to the predetermined potential.

SUMMARY OF THE INVENTION

The present invention provides for 5 cycle electrophotographic color printing architectures. During a first cycle a photoreceptor is charged, exposed to create a first electrostatic latent representation of a first color image, and developed to produce a first toner layer using toner of a first color. During a second cycle the photoreceptor with the first toner layer is recharged, beneficially using split charging stations, exposed to create a second electrostatic latent representation of a second color image, and then developed to produce a second toner layer using toner of a second color.

During a third cycle the photoreceptor with the first and second toner layers is recharged (beneficially using the same split charging stations), exposed to create a third electrostatic latent representation of a third color image, and then developed to produce a third toner layer using toner of a third color. During a fourth cycle the photoreceptor with the first, second, and third toner layers is recharged (beneficially using the same split charging stations), exposed to create a fourth electrostatic latent representation of a fourth color image, and then developed to produce a fourth toner layer using toner of a fourth color. During a fifth cycle the four toner layers are transferred onto a substrate. Beneficially, transfer is performed by exposing the toner layers on the image area using a pretransfer erase lamp, charging the image area to assist in transfer of the toner layers onto a substrate, and then transferring the toner images onto the substrate by spraying ions onto the back of the substrate. Preferably the toner layers are fused with the substrate after transfer. The fifth cycle beneficially includes a step of cleaning the photoreceptor after transfer.

BRIEF DESCRIPTION OF THE DRAWINGS

Other aspects of the present invention will become apparent as the following description proceeds and upon reference to.

DETAILED DESCRIPTION OF THE PREFERRED EMBODIMENT

The preferred embodiment of the present invention includes a plurality of individual subsystems which are known in the prior art but which are organized and used so as to produce a color image in 5 passes, or cycles, of a photoreceptive member. While the 5 cycle color electrophotographic architecture results in a 20% loss of productivity over a comparable 4 cycle color electrophotographic architecture, the additional cycle allows for significant size and cost reductions.

Figure 1:
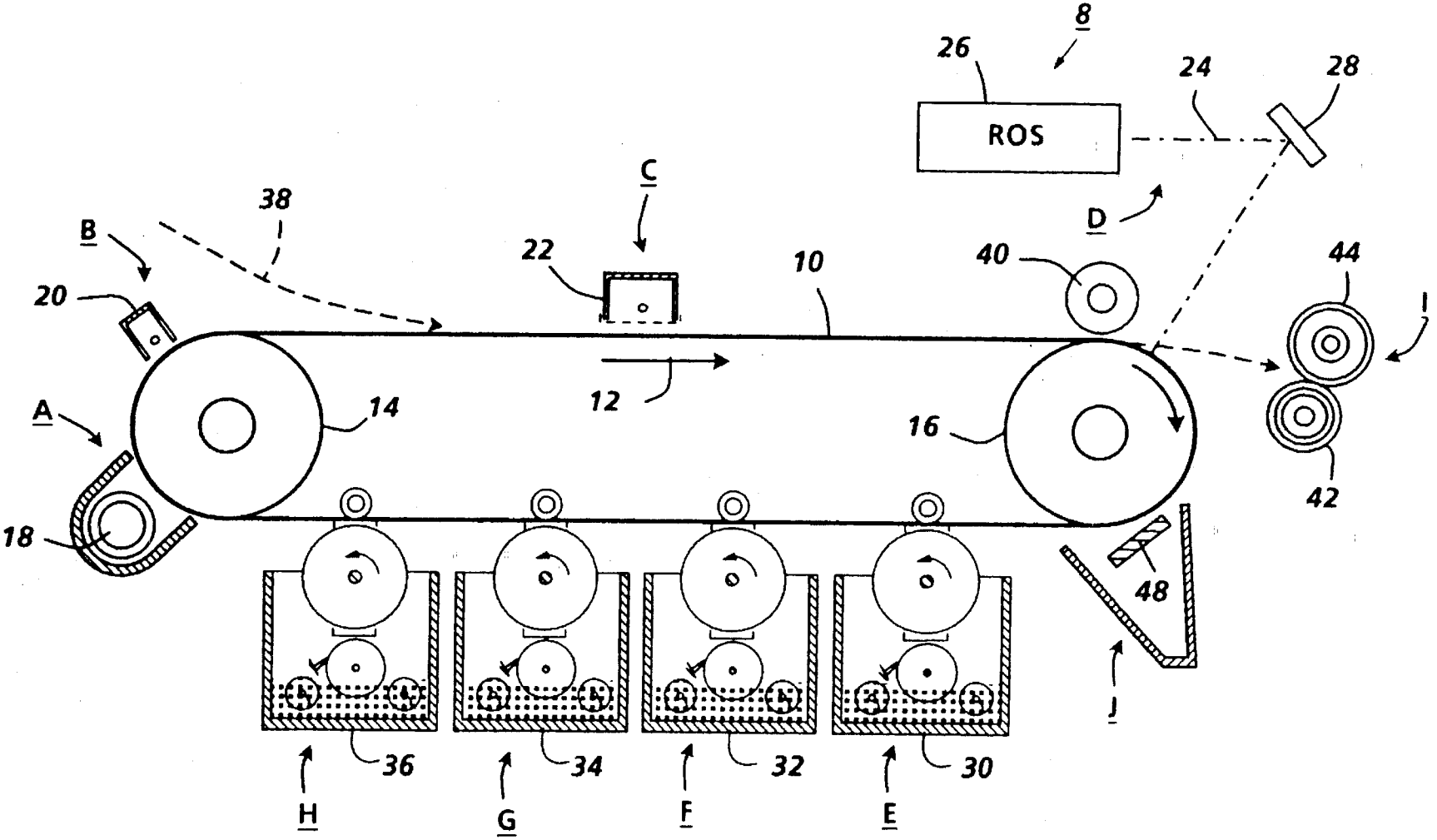
FIG. 1, which schematically illustrates an electrophotographic printing machine suitable for implementing the principles of the present invention.

FIG. 1 illustrates a color electrophotographic printing machine 8 which is suitable for implementing the principles of the present invention. The printing machine 8 includes an Active Matrix (AMAT) photoreceptor belt 10 which travels in the direction indicated by the arrow 12. Belt travel is brought about by mounting the belt about a drive roller 14 (which is driven by a motor which is not shown) and a tension roller 16.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas since each image area is processed in the same way a description of the processing of one image area suffices to fully explain the operation of the printing machine.

As previously mentioned, the production of a color document takes place in 5 cycles. The first cycle begins with the image area passing through an erase station A. At the erase station an erase lamp 18 illuminates the image area so as to cause any residual charge which might exist on the image area to be discharged. Such erase lamps and their use in erase stations are well known. Light emitting diodes are commonly used as erase lamps.

Figure 2A:
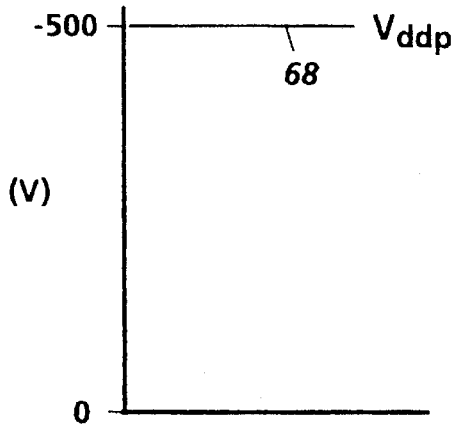
FIG. 2A, which shows the voltage profile of an image area in the electrophotographic printing machines illustrated in FIGS. 1 after that image area has been charged.

As the photoreceptor belt continues its travel the image area passes through a first charging station B. At the first charging station B a corona generating device 20, beneficially a DC pin corotron, charges the image area to a relatively high and substantially uniform potential of, for example, about –700 volts. After passing the corona generating device 20 the image area passes through a second charging station C which partially discharges the image area to, for example, about –500 volts. The second charging station C uses an AC scorotron 22 to generate the required ions. FIG. 2A illustrates a typical voltage profile 68 of an image area after that image area has past through the second charging station C.

The use of a first charging station to overcharge the image area and a subsequent second charging station to neutralize the overcharge is referred to as split charging. A more complete description of split charging may be found in co-pending and commonly assigned U.S. Patent application, "Split Recharge Method and Apparatus for Color Image Formation," Ser. No. 08/347,617 (which is hereby incorporated by reference). Since split charging is beneficial for recharging a photoreceptor which already has a developed toner layer, and since the image area does not have such a toner layer during the first cycle, split charging is not required during the first cycle. If split charging is not used in the first cycle either the corona generating device 20 or the scorotron 22 corona could be used to simply charge the image area to the desired level of–500 volts.

Figure 2B:
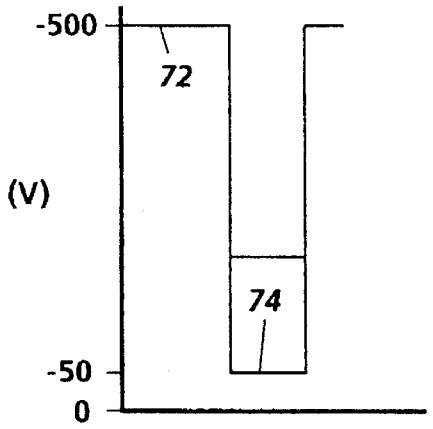
FIG. 2B, which shows the voltage profile of the image area after being exposed in the first cycle.

After passing through the second charging station C the now charged image area passes through an exposure station D. At the exposure station D the charged image area is exposed to the output 24 of a laser based output scanning device 26 and which reflects from a mirror 28. During the first cycle the output 24 illuminates the image area with a light representation of a first color (say black) image. That light representation discharges some parts of the image area so as to create an electrostatic latent representation of the exposing light. For example, illuminated sections of the image area might be discharged by the output 24 to about –50 volts. Thus after exposure the image area has a voltage profile comprised of relatively high voltages of about –500 volts and of relatively low voltages of about –50 volts. FIG. 2B shows the typical voltage profile which might exist on the image area after exposure. The voltage level 72 (about –500 volts) exists on those parts of the image area which were not illuminated, while the voltage level 74 (about –50 volts) exists on those parts which were illuminated.

Figure 2C:
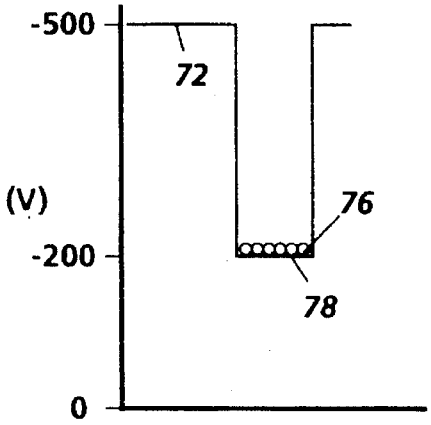
FIG. 2C, which shows the voltage profile of the image area after being developed in the first cycle.

After passing through the exposure station D the exposed image area passes through a first development station E which deposits a first color of negatively charged toner 30, black, onto the image area. FIG. 2C shows the voltage profile of the image area after the image area has passed through the first development station E. Toner 76, which adheres to the illuminated image area, is charged to a negative voltage. This causes the voltage level in the illuminated area to be about –200 volts, as represented by the solid line 78. The non-illuminated parts of the image area remain at the level 72. Thus after development the toned parts of the image area are charged to about –200 volts while the untoned parts are charged to about –500 volts.

While the first development station could be a magnetic brush developer, a scavengeless developer may be somewhat better. Scavengeless development is well known and is described in U.S. Pat. No. 4,984,019 entitled, "Electrode Wire Cleaning," issued 3 January 1991 to Folkins; in U.S. Pat. No. 4,868,600 entitled "Scavengeless Development Apparatus for Use in Highlight Color Imaging," issued 19 September 1989 to Hayes et al.; in U.S. Pat. No. 5.010,367 entitled "Dual AC Development System for Controlling The Spacing of a Toner Cloud," issued 23 April 1991 to Hays; in U.S. Pat. No. 5,253,016 entitled, "Contaminant Control for Scavengeless Development in a Xerographic Apparatus," issued on 12 October 1993 to Behe et al.; and in U.S. Pat. No. 5,341,197 entitled, "Proper Charging of Doner Roll in Hybrid Development," issued to Folkins et al. on 23 August 1994. Those patents are hereby incorporated by reference.

One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development station (described below) use scavengeless development it may be better to use scavengeless development at each development station.

Figure 2D:
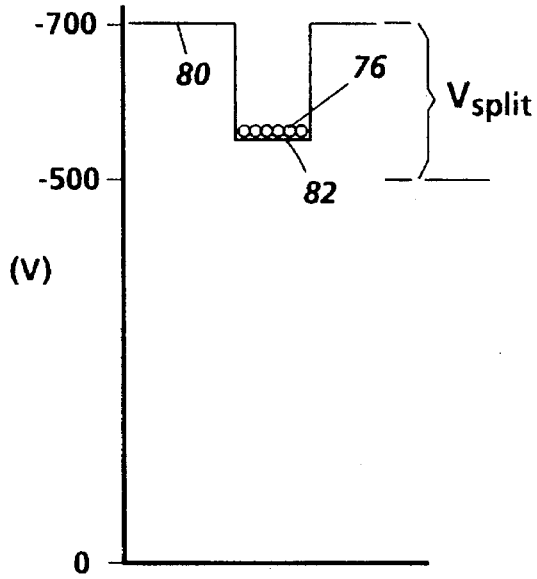
FIG. 2D, which shows the voltage profile of the image area with a toner layer after being recharged by a first charging station.

After passing through the first development station E, the image area advances so as to return to the first charging station B. The second cycle begins. The first charging station B uses its corona generating device 20 to overcharge the image area and its toner 76 (on section 82 of FIG. 2D) to more negative voltage levels than that which the image area and its first toner layer are to have when they are exposed. For example, as shown in FIG. 2D the image areas may be charged to a potential 80 of about –700 volts.

Figure 2E:
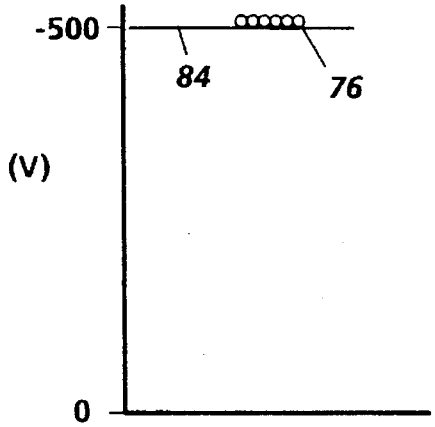
FIG. 2E, which shows the voltage profile of the image area with a toner layer after being recharged by a second charging station.

At the second charging station C the AC scorotron 22 reduces the negative charge on the image area by applying positive ions so as to charge the image area. As shown in FIG. 2E, after the image area passes the second charging station both the untoned parts and the toned parts (represented by toner 76) of the image area are at a potential 84, say of about –500 volts.

While the average potential of the toner layer after it passes through the second charging station has the potential 84, individual toner particles which comprise the toner layer will have potentials which vary widely. Since the second charging station supplies positive ions to the toner layer some of the toner particles are positively charged. Furthermore, toner particles near the exposed surface of the toner layer tend to be more positively charged than toner particles nearer to the photoreceptor.

An advantage of using an AC scorotron at the second charging station is that it has a high operating slope: a small voltage variation on the image area can result in large charging currents being applied to the image area. Beneficially, the voltage applied to the metallic grid of the AC scorotron 22 can be used to control the voltage at which charging currents are supplied to the image area. A disadvantage of using an AC scorotron is that it, like most other AC operated charging devices, tends to generate more ozone than comparable DC operated charging devices.

Figure 2F:
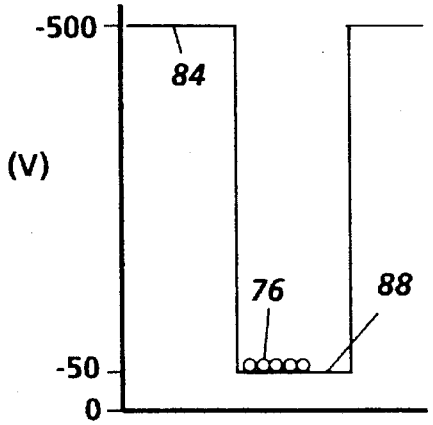
FIG. 2F, which shows the voltage profile of the image area after being re-exposed.

After passing through the second charging station C the now substantially uniformly charged image area with its first toner layer advances to the exposure station D. At the exposure station D the recharged image area is again exposed to the output 24 of a laser based output scanning device 26. During this cycle the scanning device 26 illuminates the image area with a light representation of a second color (say yellow) image. That light representation discharges some parts of the image area so as to create a second electrostatic latent representation. For example, FIG. 2F illustrates the potentials on the image area after it passes through the exposure station D the second time. As shown, the non-illuminated areas have a potential about −500 as denoted by the level 84. However, the illuminated areas, both the previously toned areas denoted by the toner 76 and the untoned areas, denoted by potential line 88, are discharged to about −50 volts. It should be understood that while the average potential of the toner layer may be at the potential 88, individual toner particles in the toner layer will have potentials which vary widely. Some of those toner particles will have a positive charge.

After passing through the exposure station D the now exposed image area passes through a second development station F which deposits a second color of toner 32, yellow, onto the image area. Since the image area has a first toner layer the second development station F should be a scavengeless developer.

After passing through the second development station F the image area and its two toner layers returns to the first charging station B. The third cycle begins. The first charging station B again uses its corona generating device 20 to overcharge the image area and its two toner layers to more negative voltage levels than that which the image area and its two toner layer are to have when they are exposed. The second charging station C again reduces the image area potentials to about −500 volts. As before while the average potential of the toner layer may be at the potential 84 the individual toner particles in the toner layer will have potentials which vary widely. The substantially uniformly charged image area with its two toner layers then advances again to the exposure station D. At exposure station D the image area is again exposed to the output 24 of the laser based output scanning device 26. During this cycle the scanning device 26 illuminates the image area with a light representation of a third color (say magenta) image. That light representation discharges some parts of the image area so as to create a third electrostatic latent representation.

After passing through the exposure station D the third time the image area passes through a third development station G. The third development station G, preferably a scavengeless developer, advances a third color of toner 34, magenta, onto the image area. The result is a third toner layer on the image area.

The image area with its three toner layers then advances back to the charging station B. The fourth cycle begins. The first charging station B once again uses its corona generating device 20 to overcharge the image area (and its three toner layers) to more negative voltage levels than that which the image area is to have when it is exposed (say about −500 volts). The second charging station C once again reduces the image area potentials to about −500 volts. The substantially uniformly charged image area with its three toner layers then advances yet again to the exposure station D. At the exposure station D the recharged image area is again exposed to the output 24 of the laser based output scanning device 26. During this cycle the scanning device 26 illuminates the image area with a light representation of a fourth color (say cyan) image. That light representation discharges some parts of the image area so as to create a fourth electrostatic latent representation.

After passing through the exposure station D the fourth time the image area passes through a fourth development station H. The fourth development station, also a scavengeless developer, advances a fourth color of toner 36, cyan, onto the image area. This marks the end of the fourth cycle.

After completing the fourth cycle the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it becomes necessary to prepare the charges on the toner layer for transfer.

The fifth cycle begins by passing the image area through the erase station A. At erase station A the erase lamp 18 discharges the image area to a relatively low voltage level. This reduces the potentials of the image area, including that of the composite color powder image, to potentials near zero. The image area with its composite color powder image then passes to the charging station B. During the fifth cycle the charging station B performs a pre-transfer charging function. The first charging device supplies sufficient negative ions to the image area that substantially all of the previously positively charged toner particles are reversed in polarity. Importantly, positive charges, which because of the polarities used in the subsequently described transfer station are the most difficult to transfer, are also reduced to levels near zero.

As the image area continues in its travel past the first charging station B a substrate 38 is advanced into place over the image area using a sheet feeder (which is not shown). As the image area and substrate continue their travel they pass through the charging station C.

At charging station C the second charging device 22 applies positive ions onto the exposed surface of the substrate 38. The positive ions attract the negatively charged toner particles on the image area to the substrate. As the substrate continues its travel the substrate passes a bias transfer roll 40 which assists in attracting the toner particles to the substrate and in separating the substrate with its composite color powder image from the photoreceptor belt 10. The substrate is then directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

As previously used the term substrate has seemed to mean simply a copy sheet. However, a substrate can also be other types of reception surfaces, specifically including an intermediate transfer member. If an intermediate transfer member is used the second charging station will not be used to transfer the negatively charged toner particles. Rather an intermediate transfer station will be located adjacent the photoreceptor belt after the first charging station. Generally the intermediate transfer station will include a charged intermediate transfer member which will attract the negatively charged toner particles on the intermediate transfer member. However, a printing machine which does not use an intermediate transfer member will usually be lower in cost than one which does use such a member.

After the substrate is separated from the photoreceptor belt 10 the image area continues its travel and eventually enters a cleaning station J. At cleaning station J a cleaning blade 48 is brought into contact with the image area. That blade wipes residual toner particles from the image area. The image area then passes once again to the erase station A and the 5 cycle printing process begins again.

The various machine functions described above are generally managed and regulated by a controller which provides electrical command signals for controlling the operations described above.

5 cycle printing architectures have a number of advantages. First, the variable mechanical loading which occurs in transfer and cleaning occur only in the fifth cycle. The variable mechanical loading which occurs in it simplifies the registering of the four toner layers. Second, the paper path can be very short. If the 5 cycle architecture is implemented as in FIG. 1 the printing system is relatively insensitive to contamination since the dirt sensitive stations (the exposure station, the charging stations and the transfer stations) are all located above the dirt producing stations (the developing stations and the cleaning station). Additionally, 5 cycle printing architectures can benefit from efficient multiple uses of various stations. For example, the charging station B can be used for charging, for recharging, and for pretransfer charging. Likewise, the charging station C can be used not only for charging and recharging, but also for transfer. The erase station can also be used for both main erasing and for pretransfer erasing.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A method of producing a color image using a printing machine having a continuous photoreceptive member, the method comprising the step of:

(a) identifying an image area on the photoreceptive member;

(b) producing a first toner image on the image area during a first cycle of the image area through the printing machine by performing the steps of.

charging the image area to a substantially uniform potential:

exposing the charged image area so as to create a first latent representation of a first color image;

developing the first latent representation so as to produce a first toner layer using toner of a first color;

(c) producing a second toner image on the image area during a second cycle of the image area through the machine by performing the steps of:

recharging the image area to a substantially uniform potential;

exposing the recharged image area so as to create a second latent representation of a second color image;

developing the second latent representation so as to produce a second toner layer using toner of a second color;

(d) producing a third toner layer on the image area during a third cycle of the image area through the machine by performing the steps of:

recharging the image area to a substantially uniform potential;

exposing the recharged image area so as to create a third latent representation of a third color image;

developing the third latent representation so as to produce a third toner layer using toner of a third color;

(e) producing a fourth toner layer on the image area during a fourth cycle of the image area through the machine by performing the steps of:

recharging the image area to a substantially uniform potential;

exposing the recharged image area so as to create a fourth latent representation of a fourth color image;

developing the fourth latent representation so as to produce a fourth toner layer using toner of a fourth color;

(f) transferring the toner layers on the image area onto a substrate during a fifth cycle of the image area through the printing machine; and (g) passing the substrate between the photoreceptor and an exposure station.

2. A method of producing a color image using a printing machine having a continuous photoreceptive member, the method comprising the step of:

(a) identifying an image area on the photoreceptive member;

(b) producing a first toner image on the image area during a first cycle of the image area through the printing machine by performing the steps of:

charging the image area to a substantially uniform potential;

exposing the charged image area so as to create a first latent representation of a first color image;

developing the first latent representation so as to produce a first toner layer using toner of a first color;

(c) producing a second toner image on the image area during a second cycle of the image area through the machine by performing the steps of:

recharging the image area to a substantially uniform potential;

exposing the recharged image area so as to create a second latent representation of a second color image;

developing the second latent representation so as to produce a second toner layer using toner of a second color;

(d) producing a third toner layer on the image area during a third cycle of the image area through the machine by performing the steps of:

recharging the image area to a substantially uniform potential;

exposing the recharged image area so as to create a third latent representation of a third color image;

developing the third latent representation so as to produce a third toner layer using toner of a third color;

(e) producing a fourth toner layer on the image area during a fourth cycle of the image area through the machine by performing the steps of:

recharging the image area to a substantially uniform potential;

exposing the recharged image area so as to create a fourth latent representation of a fourth color image;

developing the fourth latent representation so as to produce a fourth toner layer using toner of a fourth color; and (f) erase exposing the toner layers on the image area prior to the transfer of the toner layers onto the substrate and then transferring the toner layers on the image area onto a substrate during a fifth cycle of the image area through the printing machine.

3. A method of producing a color image using a printing machine having a continuous photoreceptive member, the method comprising the step of:

(a) identifying an image area on the photoreceptive member;

(b) producing a first toner image on the image area during a first cycle of the image area through the printing machine by performing the steps of:

charging the image area to a substantially uniform potential;

exposing the charged image area so as to create a first latent representation of a first color image;

developing the first latent representation so as to produce a first toner layer using toner of a first color;

(c) producing a second toner image on the image area during a second cycle of the image area through the machine by performing the steps of:

recharging the image area to a substantially uniform potential;

exposing the recharged image area so as to create a second latent representation of a second color image;

developing the second latent representation using a scavengeless developer so as to produce a second toner layer using toner of a second color;

(d) producing a third toner layer on the image area during a third cycle of the image area through the machine by performing the steps of:

recharging the image area to a substantially uniform potential;

exposing the recharged image area so as to create a third latent representation of a third color image;

developing the third latent representation so as to produce a third toner layer using toner of a third color;

(e) producing a fourth toner layer on the image area during a fourth cycle of the image area through the machine by performing the steps of:

recharging the image area to a substantially uniform potential;

exposing the recharged image area so as to create a fourth latent representation of a fourth color image;

developing the fourth latent representation so as to produce a fourth toner layer using toner of a fourth color;

(f) transferring the toner layers on the image area onto a substrate during a fifth cycle of the image area through the printing machine.

* * * * *